United States Patent [19]

Belson

[11] 4,106,121

[45] Aug. 15, 1978

[54] TACTICAL LOAD BEARING VEST

[76] Inventor: Gary W. Belson, 25 First St., Barnegat, N.J. 08005

[21] Appl. No.: 745,964

[22] Filed: Nov. 29, 1976

[51] Int. Cl.[2] ..... A41D 1/04

[52] U.S. Cl. ..... 2/102

[58] Field of Search ..... 2/102, 94, 96, 247, 2/249, 250, DIG. 6; 224/5 MC

[56] References Cited

U.S. PATENT DOCUMENTS

| | | | |
|---|---|---|---|
| 314,333 | 3/1885 | Heller | 2/94 X |
| 2,717,437 | 9/1955 | Mestral | 2/96 |
| 2,745,160 | 5/1956 | Jones | 2/96 |
| 3,529,307 | 9/1970 | Belson et al. | 2/94 |
| 3,782,614 | 1/1974 | Campisi | 224/5 K |

*Primary Examiner*—Doris L. Troutman

*Attorney, Agent, or Firm*—Frailey & Ratner

[57] ABSTRACT

A snug fitting tactical load bearing vest having a left and a right vest section with a slide fastener for connecting together a portion of the front edges of the vest sections. The rear edges of the vest sections are adjustably connected in accordance with the fit of the wearer. Hook and mesh fastening means are used to secure supply pouches to the vest. Each of the pouches has a rearwardly mounted web with button portions of snap fasteners secured to the web and the posts thereof secured to the vest.

11 Claims, 8 Drawing Figures

FIG. 1
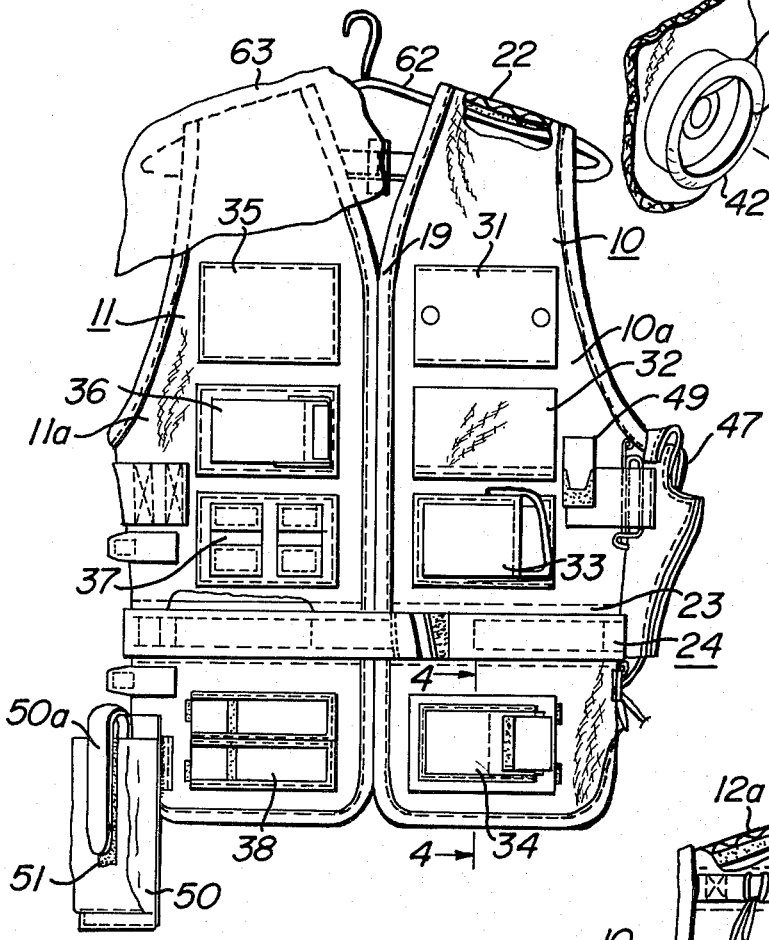
FIG. 5
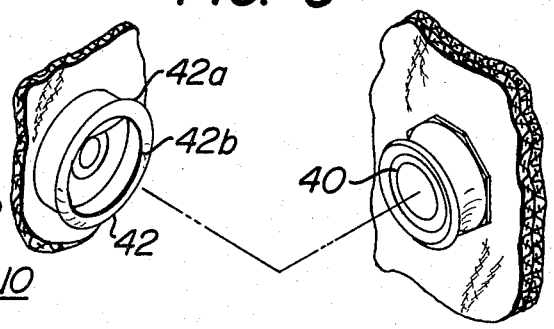
FIG. 2
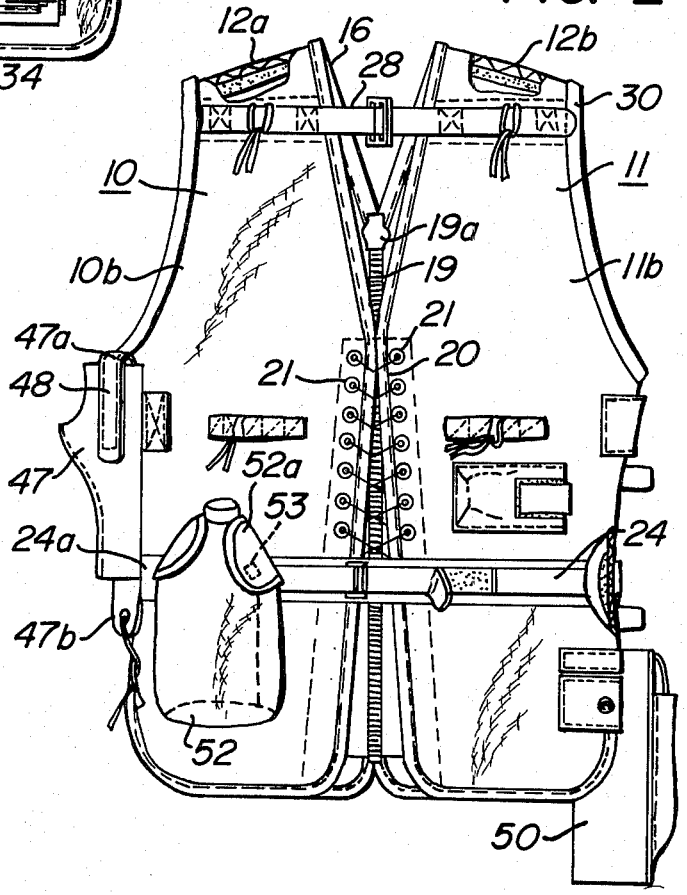
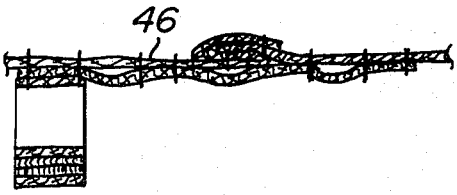
FIG. 6

FIG. 3
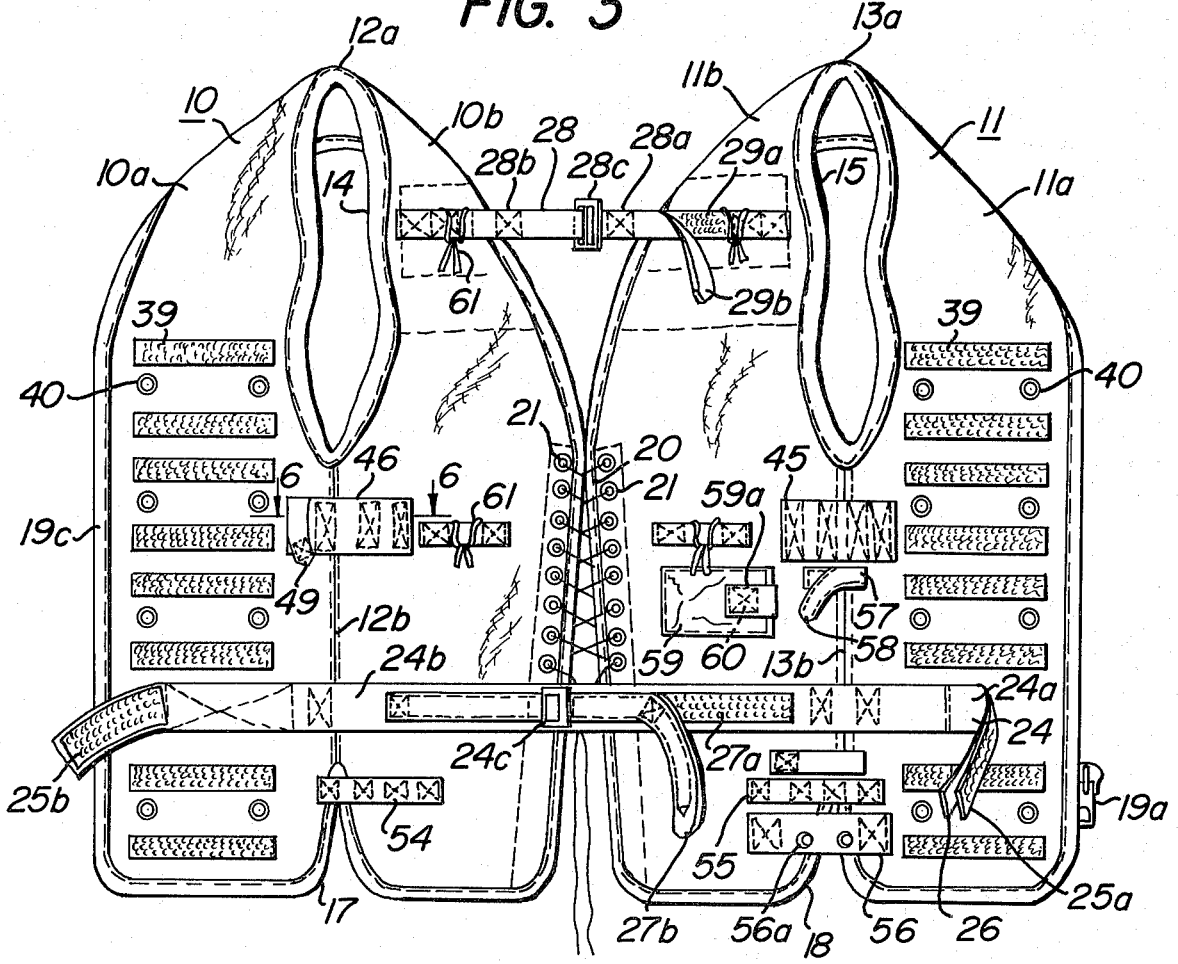
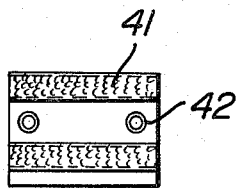
FIG. 7
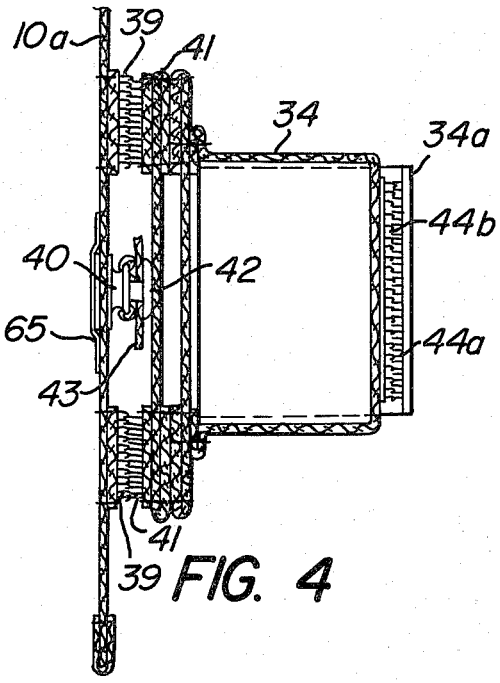
FIG. 4
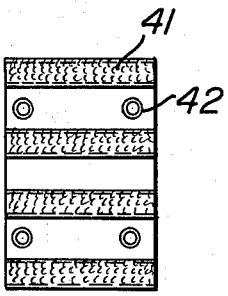
FIG. 8

TACTICAL LOAD BEARING VEST

BACKGROUND OF THE INVENTION

A. Field of the Invention

This invention relates to the field of art of tactical vests.

B. Prior Art

In military operations of recent years, soldiers have often found themselves in the position of fighting at close quarters. In such situations, there is an important need for ammunition, rations, auxiliary weapons, radios and ancillary supplies carried by the soldier to be constrained close to the body to prevent entanglement with the foliage and to minimize the noise created by such objects. At the same time, it has been desired to permit ready access by the soldier to any of the supplies even though he may be pinned down to the ground by enemy fire or the need to camouflage himself. A vest which meets these requirements has been described in U.S. Pat. No. 3,529,307.

Domestic police forces charged with the responsibility of combating criminals have operated individually or in groups and have found military equipment useful in these missions. Teams of such police have been known as "Special Weapons and Tactics" (S.W.A.T.), Barricade Teams", "Stake Out Squads". The responsibility of the police is to subdue the criminal and take him alive if possible. Such situations often arrive on short notice and dictate the requirement that the vest be made operational with very little loss of time and efficiency. Furthermore, there is the need for close proximity of the policeman to the criminal.

It is further desirable that such a vest fit snugly over the body with or without armor or with partial armor worn underneath. By fitting the body snugly, the weight of ancillary supplies carried on the outside surface of the vest is distributed over a wider portion of the torso rather than concentrated on the shoulders of the wearer. Circumferential tension exerted by the closed vest is believed to have two additional advantages. If armor is worn underneath, the tension of the vest may increase its overall resistance to ballistic projectives resulting in a shallow deflection over a wide area of the body rather than a sharp deflection in a more concentrated area thus reducing the injury known as blunt trauma. This tension also exerts a pressure in the body such that if a bullet does penetrate the vest and the wearer's body and with a force sufficient to completely penetrate the body, the bullet will exit leaving a clean hole rather than a large laceration through which body tissues might be lost. This type of injury is known as ballistic hydraulic blowout.

SUMMARY OF THE INVENTION

A snug fitting tactical load bearing vest having a left vest section and a right vest section. A portion of the front edges of the left and right vest sections are separably connected. At least portion of the rear edges of the vest sections are adjustably connected in accordance with the fit of the wearer. At least one removable supply pouch is provided and hook and mesh fastening means comprises at least one fastening strip of hook devices and at least one fastening strip of mesh devices. At least one fastening strip of one device type is secured to the rear surface of the pouch. At least one fastener strip of the other device type is secured to the outside surface of the vest for engaging the pouch fastening strip thereby to releasably secure the entirety of pouch to the vest.

BRIEF DESCRIPTION OF THE DRAWINGS

FIG. 1 is a front view of a tactical vest in accordance with the invention;

FIG. 2 is a rear view of FIG. 1;

FIG. 3 is an exterior view of the vest sections separated at the front and spread open;

FIG. 4 is a cross-section view of a pouch shown in FIG. 1;

FIG. 5 is a detailed view of a snap fastener shown in FIG. 4;

FIG. 6 is a cross-sectional view of a web shown in FIG. 3;

FIG. 7 is the attachment side of a single section pouch or cover shown in FIG. 1; and FIG. 8 is the attachment side of a double section pouch or cover which could occupy the area occupied by two adjacent single section pouches or covers shown in FIG. 1.

DETAILED DESCRIPTION

Referring now to FIGS. 1–3, there is shown a tactical vest comprising a left section 10 and a right section 11. Left section 10 is formed of a left front panel 10*a* and a left rear panel 10*b*. "Left" in this context refers to the side of the wearer's body covered by the section.

Similarly, right section 11 is composed of right front panel 11*a* and right rear panel 11*b*. Front and rear panels 10*a* and 10*b* are joined together by lines of stitching 12*a* at the left shoulder and 12*b* along the left side. Similarly, the front and rear panels of right section 11 are joined at the right shoulder and the right side by lines of stitching 13*a* and 13*b*. Panels 10*a* and 10*b* are cut to provide a left armhole 14 and to agree with the curvature of the left side of the wearer's body. Similarly, panels 11*a* and 11*b* are cut to provide a right armhole 15 and to agree with the curvature of the right side of the wearer's body. In general, left section 10 and right section 11 are symmetrical.

Left section 10 and right section 11 are joined together at the rear of the wearer's body by a back lace 20 which is threaded through a multiplicity of lace grommets 21 disposed along the rear edges of sections 10 and 11. This lace is adjusted by the wearer to provide a snug but comfortable fit when the front edges of the vest sections are fastened together. A quick-release type slide fastener 19 is installed to permit fastening the front edges of the vest sections. More specifically, one set of slide fastener teeth 19*b* is installed along the front edge of left section 10 and another mating set of teeth 19*c* is installed along the front edge of right section 11. These teeth are meshed together by the action of slide 19*a* in a well known manner.

The vest panels are contoured to form the lower side vents 17 and 18 when the panels are stitched together and to provide a V-shaped neck opening 16 when sections 10 and 11 are joined by the wearer. These openings are shaped to provide optimum comfort and articulation and ventilation of the wearer's body. Padding 22 as shown in FIG. 1 is sewn into the interior surface of the top shoulder area of each section to alleviate chafing of the wearer's shoulders while wearing this vest. Waist padding 23 is sewn into the interior surface of both panels as shown in FIG. 1 to alleviate chafing at the waist.

To assure a snug and comfortable fit of the vest on the wearer's body, the vest is equipped with a waist belt 24 and a shoulder adjustment belt 28. Waist belt 24 comprises a right belt section 24*a* and a left belt section 24*b* which are sewn respectively to the right and left vest sections. A belt adjusting buckle 24*c* is sewn into the left section 24*b*. The end of belt section 24*a* is threaded through buckle 24*c* in a conventional manner and adjusted by the user to set the desired spacing at this point between vest sections 10 and 11 while worn.

The other ends of the waist belt sections which meet at the front of the wearer's body are not equipped with a buckle. The interior surface of the front end of waist belt section 24*a* and the exterior surface of the front end of waist belt section 24*b* have installed upon them mating strips of a hook and mesh fastener 25. This hook and mesh fastener is known widely by its trade name Velcro and shall be referred to hereafter by that name. A Velcro fastener consists of a strip of cloth webbing on which a multitude of split loops of small diameter nylon fiber project and a second cloth webbing faced with a random mesh of nylon thread. When lightly pressed together the threads of the mesh entangle the hooks formed by the split loops, and the strips subsequently require a significant tearing force to disengage them. Where utilized in the construction of this invention, the mating surfaces of such fasteners shall be referred to as hook strips and mesh strips.

When the wearer dons the tactical vest, the front ends of the waist belt 24 are pulled toward each other to establish a snug but comfortable tension at the waist and the hook strip 25*a* is pressed against the mesh strip 25*b* thus fastening the ends of the waist belt sections to provide circumferential tension about the body. These ends will remain firmly in place and will only be parted when the end of hook strip 25*a* is pulled away from mesh strip 25*b* in an outward "tearing" motion. To allow rapid disengagement of the belt by the wearer, a short section of the end of belt section 24*a* is left unstitched to hook strip 25*a* to form pull tab 26. Pull tab 26 when grasped by the wearer and pulled radially outward from the body will part the end areas of 25*a* and 25*b* from each other after which the complete parting continues in a tearing manner. At the rear end of belt section 24*a*, a portion of the exterior surface near the rear edge is faced with a hook strip 27*a* while the short portion of the end of the belt is faced with a mesh strip 27*b*. This allows the end of the waist belt to be secured against itself after being threaded through budle 24*c* thus keeping it from dangling and inadvertent peeling release.

The Velcro closures offer a further advantage as applied in this invention. When immersed in water, the surface friction between the nylon fibers is reduced and the hook and mesh strips part more easily. Thus if the wearer should become accidentally submerged in water, he can more quickly doff the heavy vest to avoid drowning.

Shoulder adjustment belt 28 is constructed in a manner similar to the rear portions of the waist belt 24. Shoulder adjustment belt 28 comprises right section 28*a* and left section 28*b* which are stitched to the right and left vest sections 11 and 10 respectively. A buckle 28*a* is fastened onto section 28*b*. In use, the end of belt 28*a* is threaded through the buckle and tightened in a conventional manner to establish a comfortable spacing between the vest sections across the wearer's rear shoulders. The exterior of belt section 28*a* is faced with hook strip 29*a* at the body of the vest and with a mesh strip on its end as shown in FIG. 3 so that the end can be secured against the body, after adjusting the buckle, to prevent it from dangling. The reenforcement backing 30 as shown in FIG. 2 is stitched into the interior surface of each vest section underneath the ends of the shoulder adjustment belt to provide a solid anchorage for the belt ends.

A multitude of supply pouches are shown attached to the front of the vest in FIG. 1. The specific items shown here are a hand gun cartridge pouch 31, a shotgun shell pouch 32, a rifle cartridge clip pouch 33, a first aid pouch 34, a single section fastener cover 35, a carbine clip pouch 36, a hand gun cartridge drop pouch 37 and a pistol clip pouch 38. The forementioned pouches are similar in function although they differ from each other in detail. Each pouch comprises a rectangular base of heavy fabric similar to that used on the main body of the vest; and a fabric pocket having one or more ends extended to fold over to cover the open end to prevent loss of the supplies stored within. Some pouches have webbing stitched onto the base to form loops that hold ammunition rounds of specific size. The inside surface of the ends of the pouch covers or flaps are faced with one or more strips of Velcro mesh material which when closed mate with corresponding strips of Velcro hook material sewn onto the outside surface of the body of the pouch. This provides a means for keeping the covers closed yet allowing ready access to the contents by the wearer simply by pulling the flaps away from the pouch.

The cover consists simply of a rectangular fabric base with no appurtenant pocket, cover or webbing loops.

The supply pouches described above do not represent an exhaustive catalog of available types. Other carrying pouches are available which differ in purpose and detail but which possess the closing and mounting means described herein for the items named.

FIG. 3 illustrates the mounting means for the previously described pouches. The front panels of both sections of the vest have a plurality of Velcro hook sections 39 and snap fastener posts 40 stitched to the fabric of the vest. Each post is anchored in a reenforcing strip 65 (FIG. 4) to prevent it from being pulled from the vest. These items are arranged along left vest section 10 starting with hook strip 39 at the top underneath which a pair of snap posts 40 are mounted followed by a hook strip underneath the snap posts such that the snap posts are equidistant between the upper and lower hook strips. The second arrangement of two hook strips and two snap posts is installed under the first arrangement with the lengths and spacings equal. Similarly, a third arrangement is installed under the second arrangement and finally a fourth arrangement is installed at the bottom of the panel. The front of the right vest section 11 is faced with these arrangements in an identical manner. In summary, each of the aforesaid arrangements of hook strips and posts are congruent to each other. The rear surface of each pouch or cover previously described has a coinciding arrangement of Velcro mesh strips and snap fastener buttons stitched to them such that when any pouch is positioned against the mounting arrangement, the Velcro hook and mesh strips will engage each other and the posts and buttons of the snap fasteners will coincide.

A cross section of first aid pouch 34 is illustrated in FIG. 4. The mounting means for this pouch is typical for the other pouches. Velcro hook strips 39 and snap fastener posts 40 are fastened to the vest panel 10*a* as previously described. On the pouch a longitudinal web 43 is stitched to the right and left extremities of the pouch base and have snap fastener buttons 42 mounted to them as illustrated in FIG. 4. Longitudinal strips of Velcro mesh are secured to the top and bottom edges of the pouch. When the pouch is fastened to the vest, the snap buttons are engaged to the snap posts in addition to the Velcro hook and mesh sections being mated. An enlarged view of snap fastener button 42 and post 40 are shown in FIG. 5. Note that the button has an interior lip 42*a* which covers a portion of the snap spring 42*b*. As is well known, spring 42*b* is spread by the entering edge of post 40 and then contracts to secure a grip upon the grooved surface of the latter. In mating the button to the post, the button is canted to place the lip over the edge of post 40 following which the remainder of the button is pushed in placed snapping the spring into the groove of the post. The buttons are installed on the pouches with the button lips uppermost.

In a struggle at close quarters with an assailant, the vest wearer is protected against the loss of the pouches by this feature. Typically, an assailant will exert a clawing motion against the top edges of these pouches and will attempt to pull them away by a downward pull against the upper edges. Button lip 42*a* defeates this possibility by maintaining a firm grip within the groove of post 40. The pouch can only be removed by pulling the downward edge away from the edge with an upper motion centered on each post at a time so that the rim of the button 42 opposite the lip will clear the end of the post and then allow disengagement. Even if the assailant should grab the lower end of the pouch during a fight, he will be unable to dislodge the snap fastener because the web is stitched to the pouch only at the end and, in general, a resulting turning motion will not allow this force to be translated to the button in a direction that could cause its disengagement. The snap fasteners thus provide positive retention of the pouches to the vest in the ocassion of a violent struggle or even a fall against underbrush and other objects. The Velcro fasteners serve to maintain the pouches firmly and neatly positioned against the vest to more evenly distribute the weight of their contents and to minimize the possibility of their snagging other objects. As mentioned previously, the fastener posts are anchored to plurality of reenforcing strips 65 behind the vest panel fabric to prevent their being pulled from the vest.

In FIG. 4, the cover flap 34*a* of pouch 34 is shown in cross section with Velcro fastener hook and mesh strips 44*a, b* installed on the exterior of the pouch and the interior of cover 34*a*.

Reenforcing webs 45 and 46 are installed on each vest section just underneath the arm openings as shown in FIG. 3. Reenforcing web 46 is actually a holster base web with tunneled loops left in it by the stitching as shown in cross section in FIG. 6. These loops allow attachment clips of a holster 47 to be engaged therewith. Holster 47 permits a revolver or pistol to be carried close to the body underneath the armpit. A closure tab 47*a* and the main body of the holster are faced with mating sections of a Velcro fastener 48 to permit firm closure of the tab. A grommet 47*b* is provided at the lower end of the holster to permit lacing of the latter against the vest to keep it close to the body. A pistol butt retaining strap 49 as shown in FIGS. 1 and 3 is stitched to the holster web or vest body 46 and is faced with Velcro hook and webs such that the tab can be pulled around the butt of the pistol and secured against itself to prevent the pistol butt from slapping against the wearer's body. Use of the Velcro fasteners here and on the holster enclosure allow rapid disengagement by the wearer yet provides a firm secure means against inadvertent loosening. This also provides several points of contact distribution, thus reducing a concentration of weight.

A radio carrying pouch 50 made of fabric and having a closure strap 50*a* which is faced with a Velcro fastener 51 is provided. This can be clipped into loops formed by stitching of reenforcing strips 54 and 55 installed on the lower sides of the left or right vest section or into tunneled loops in the waist belt.

A canteen pouch 52 having two cover flaps 52*a* which are faced with a Velcro fastener 53 is provided. This item mounts to the vest by means of metal clips inserted through loops left in belt section 24*a* by stitching to the vest panels.

A side holster hanger strip 56 is installed across the side vent of the vest's right section. This is equipped with two grommet holes 56*a* to allow installation of a conventional side holster or any other item that will fit there. A holder 57 for a flashlight or nightstick is installed adjacent to reenforcing strip 35 on the vest's right section as shown in FIG. 3. This is a horizontally mounted strip having Velcro hook and mesh strips secured to its ends such that the ends of the strip can be wrapped around a flashlight, nightstick or any cylindrical object to hold it securely to the vest yet allow quick disengagement of the strap ends for use. A handcuff utility pouch 59 is mounted on the rear panel of the right vest section with its opening toward the front of the vest and having a cover flap 59*a* faced with Velcro strips to allow the retention of handcuffs or utility equipment within the pouch without restricting the ready access to them. A plurality of short pieces of lace 61 are furnished with the vest and inserted through loops left in various belts and webbing as shown for the purpose of tying miscellaneous items to the vest.

When a full complement of pouches is not worn on the vest, the Velcro hook strips 39 and posts 40 are protected against abrasion and other damage by installing covers such as the single section cover 35 previously described. The rear of this cover has installed upon it an arrangement of Velcro mesh strips 41 and snap fastener buttons 42 as shown in FIG. 7 which is similar to the arrangement on the rear of a pouch. This cover mates with the fastening arrangements as previously described. When two adjacent fastening areas of the vest are unused, these may be covered by a double section over which is pictured in FIG. 8. This cover consist of a piece of fabric on which two arrangments of Velcro mesh strips 41 and fastener post 42 are installed and spaced such that two adjacent fastening areas will be covered with the cover flat against the vest surface. It should be noted that some supply pouches for larger objects can be furnished having two or even three adjacent fastening arrangments of mesh strips 41 and snap fastener buttons 42.

When not in use, the vest is stored by means of a hanger 62 as shown in FIG. 1 with a light cloth cover 63 drawn over it to keep it clean and to protect supplies that may be stored on the vest from casual pilfering.

What is claimed is:

1. A snug fitting tactical vest comprising a left vest section and a right vest section, each section having inside and outside surfaces and a front and a rear longitudinal edge, means for separably connecting together a portion of said front edges of said left and right vest sections, means for adjustably connecting in accordance with the fit of the wearer at least a portion of the rear edges of said left and right vest sections, at least one removable supply pouch having a rear surface, and hook and mesh fastening means comprising at least one fastening strip of hook devices and at least one fastening strip of mesh devices, at least one fastening strip of one device type being secured to said rear surface of said pouch, at least one fastening strip of the other device type being secured to said outside surface of said vest for engaging the pouch fastening strip thereby to releasably secure the entirety of said pouch to said vest.

2. The vest of claim 1 in which there is provided a plurality of supply pouches, first pairs of fastening strips of one type of devices secured to the rear surface of the pouch body portion of each of said pouches, second pairs of fastening strips of the other type of devices secured to said vest, said first and second fastening strip pairs being similarly spaced so that each first pair engages each second pair for securing an associated pouch to said vest.

3. The vest of claim 2 in which there is provided at least one snap fastener, a button portion of each snap fastener being coupled to said rear surface of said pouch body portion and an associated post portion being secured to said vest adjacent the associated second pair of fastening strips.

4. The vest of claim 3 in which said post portion of each of said snap fasteners is secured to the vest between each second pair of fastening strips.

5. The vest of claim 4 in which there is provided a web for each of said pouches secured adjacent the ends of said rear surface of said pouch body portion, said button portion associated with said pouch being secured to said web.

6. The vest of claim 5 in which there is provided a pair of button portions for each pouch web and a pair of post portions secured to said vest between each second pair of fastening strips.

7. The vest of claim 6 in which each of said button portions has an upper internal lip for engagement with its associated post thereby to minimize the tendency for said button portion to disengage its associated post when a pull is exerted against the upper edge of an associated pouch.

8. The vest of claim 2 in which there is provided a left belt section joined to the outside surface of said left vest section and a right belt section joined to the outside surface of said right vest section, each of said left and right belt sections having a free front end, an additional fastening strip of one device type secured to one of said free ends for engagement with an additional fastening strip of the device type secured to the other one of said free ends.

9. The vest of claim 7 in which there is provided at least one cover pad having at least one pair of first fastening strips secured to one surface thereof for engaging and covering at least one pair of second fastening strips secured to the vest not being used to engage a pouch.

10. The vest of claim 2 in which said flap portions of said pouches provide side openings to allow the wearer access to the contents of the pouches while wearing the vest in the prone position.

11. The vest of claim 1 in which said pouch includes a pouch body portion having a rear surface and a flap portion, said pouch fastening strip being secured to said rear surface of said pouch body portion for releasable engagement with the vest fastening strip.

* * * * *